US012241371B1

(12) United States Patent
Zeng et al.

(10) Patent No.: US 12,241,371 B1
(45) Date of Patent: Mar. 4, 2025

(54) INTEGRATED MINING METHOD OF COAL BREAKING, COAL EXTRACTION AND WATER CIRCULATION IN U-WELL AND SYSTEM THEREOF

(71) Applicant: CHINA UNIVERSITY OF MINING AND TECHNOLOGY, BEIJING, Beijing (CN)

(72) Inventors: Yifan Zeng, Beijing (CN); Donghui Yang, Beijing (CN); Qiang Wu, Beijing (CN); Hao Li, Beijing (CN); Junhao Ren, Beijing (CN); Zeyang Liu, Beijing (CN); Jia Zhao, Beijing (CN); Zilong Yuan, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 18/760,362

(22) Filed: Jul. 1, 2024

(30) Foreign Application Priority Data

Dec. 8, 2023 (CN) ..... 202311685439.8

(51) Int. Cl.
*E21C 25/60* (2006.01)
*E21C 41/18* (2006.01)

(52) U.S. Cl.
CPC ..... *E21C 41/18* (2013.01); *E21C 25/60* (2013.01)

(58) Field of Classification Search
CPC ..... E21C 41/18; E21C 25/60; E21B 43/28
USPC ..... 299/16, 17, 3–6
See application file for complete search history.

(56) References Cited

U.S. PATENT DOCUMENTS 3,498,674 A * 3/1970 Matthews ..... E21C 25/60 299/5
5,246,273 A * 9/1993 Rosar ..... E21B 43/28 175/45
5,879,057 A 3/1999 Schwoebel et al.

FOREIGN PATENT DOCUMENTS

| | | | |
|---|---|---|---|
| AU | 5491373 A | | 10/1974 |
| CN | 1397717 A | | 2/2003 |
| CN | 1580489 A | | 2/2005 |
| CN | 105134213 A | | 12/2015 |
| CN | 113338801 A | * | 9/2021 |
| CN | 113338932 A | | 9/2021 |

OTHER PUBLICATIONS

First Office Action issued in counterpart Chinese Patent Application No. 202311685439.8, dated Apr. 18, 2024.

* cited by examiner

*Primary Examiner* — Sunil Singh
(74) *Attorney, Agent, or Firm* — Westbridge IP LLC

(57) ABSTRACT

Disclosed are an integrated mining method and an integrated mining system of coal breaking, coal extraction and water circulation in a U-well. The integrated mining system includes a first ground facility unit, a second ground facility unit, a jet unit and an extraction unit. The first ground facility unit is configured to transport jet fluid to the jet unit. The jet unit is configured to break a coal seam in a sub-segment to obtain broken cinders. The extraction unit is configured to extract a coal-water mixture. The second ground facility unit is configured to receive the coal-water mixture. In response to determining that an extraction of the sub-segment is complete, the jet unit and the extraction unit is configured to move to a next sub-segment using powers provided by the first ground facility unit and the second ground facility unit.

6 Claims, 3 Drawing Sheets

INTEGRATED MINING METHOD OF COAL BREAKING, COAL EXTRACTION AND WATER CIRCULATION IN U-WELL AND SYSTEM THEREOF

CROSS-REFERENCE TO RELATED APPLICATIONS

This application claims priority to Chinese Patent Application No. 202311685439.8, filed on Dec. 8, 2023, the content of which is incorporated herein by reference in its entirety.

TECHNICAL FIELD

The present application relates to coal mining technology, and in particular to an integrated mining method of coal breaking, coal extraction and water circulation in a U-well and a system thereof.

BACKGROUND

In order to improve a coal mining efficiency, improvements have to be made to coal mining and coal transportation methods. For example, to improve a coal transportation efficiency, a hydraulic fluidization mining operation can be performed on a coal seam with a high-pressure fluidizer, and a coal transportation lane in a rock formation below the coal seam may be excavated. Therefore, a coal-water mixture can be transported up to the ground through the coal transportation lane. Moreover, coal can be obtained from a coal-water separation process. Alternatively, by compressing air into the coal transportation lane using an air duct, a mixture of air, liquid, and solid can be formed, which is called as a coal-water-air mixture. Then, the coal-water-air mixture can be raised up to the ground based on differences in densities and velocities between the air and the coal-water mixture and hydrophilic actions of air bubbles.

However, in conventional coal mining methods, coal mining and coal transportation are two dependent processes. Further, limited by a dip angle, the coal-water mixture accumulated in the coal transportation lane by gravity may block the coal transportation lane easily. Therefore, the efficiency of coal mining is low. At the same time, in conventional coal mining methods, jet fluid used cannot be recycled, resulting in a waste of resources.

SUMMARY

In view of the above, examples of the present disclosure provide an integrated mining method of coal breaking, coal extraction and water circulation in a U-well and a system thereof.

The integrated mining method of coal breaking, coal extraction and water circulation in a U-well provided by example of the present disclosure can be applied in an integrated mining system of coal breaking, coal extraction and water circulation in a U-well. The integrated mining system may include: a first ground facility unit, a second ground facility unit, a jet unit and an extraction unit. The coal mining system may be disposed in a U-well, which can also be called a U-shape mining passage. The U-well or the U-shape mining passage may include a coal breaking section, an extraction hole and a coal breaking hole. The jet unit may be disposed on a side of the coal breaking section close to the extraction hole through the coal breaking hole. The extraction unit may be disposed on a side of the coal broking section close to the extraction hole through the extraction hole. The first ground facility unit may connect to the jet unit. The second ground facility unit may connect to the extraction unit. The coal breaking section may include a plurality of sub-segments.

The integrated mining method may include operations of the following steps performed iteratively until an extraction of the coal breaking section is complete: transporting, by the first ground facility unit, jet fluid to the jet unit; breaking, by the jet unit, a coal seam in a sub-segment at a current position according to a preset breaking angle and a preset breaking radius to obtain broken cinders; where, the jet unit includes: a jet lance; where, the jet lance is provided with a spray nozzle; a spray direction of the spray nozzle is at an acute angle to a directional drill pipe of the extraction unit; extracting, by the extraction unit, a coal-water mixture directionally according to a preset extraction rate; where, the coal-water mixture includes: the broken cinders and the jet fluid; receiving, by the second ground facility unit, the coal-water mixture; and in response to determining that an extraction of the sub-segment is complete, moving, by the jet unit and the extraction unit, to a next sub-segment using powers provided by the first ground facility unit and the second ground facility unit.

Based on a same inventive concept, an integrated mining system of coal breaking, coal extraction and water circulation in a U-well is provided by examples of the present disclosure. The integrated mining system may include: a first ground facility unit, a second ground facility unit, a jet unit and an extraction unit. The coal mining system is disposed in a U-well, which is a U-shape mining passage. The U-well includes a coal breaking section, an extraction hole and a coal breaking hole. The jet unit is disposed on a side of the coal breaking section close to the extraction hole through the coal breaking hole. The extraction unit is disposed on a side of the coal broking section close to the extraction hole through the extraction hole. The first ground facility unit is connected to the jet unit. The second ground facility unit is connected to the extraction unit. The coal breaking section includes a plurality of sub-segments.

The first ground facility unit, the jet unit, the extraction unit, and the second ground facility unit are configured to perform the following operations iteratively until the extraction of the coal breaking section is complete.

The first ground facility unit is configured to transport jet fluid to the jet unit.

The jet unit is configured to break a coal seam in a sub-segment at a current position according to a preset breaking angle and a preset breaking radius to obtain broken cinders; where, the jet unit includes: a jet lance; where, the jet lance is provided with a spray nozzle; a spray direction of the spray nozzle is at an acute angle to a directional drill pipe of the extraction unit.

The extraction unit is configured to extract a coal-water mixture directionally according to a preset extraction rate; where, the coal-water mixture includes: the broken cinders and the jet fluid.

The second ground facility unit is configured to receive the coal-water mixture.

In response to determining that an extraction of the sub-segment is complete, the jet unit and the extraction unit is configured to move to a next sub-segment using powers provided by the first ground facility unit and the second ground facility unit.

According to the above descriptions, in the integrated mining method and the integrated mining system of the U-well proposed by examples of the present disclosure, the ability of coal breaking of the jet breaking technology can be combined with the ability of efficient washing of the air lift reverse circulation technology and with the ability of recycling the jet fluid of the first ground facility unit and the second ground facility unit. In this way, an integrated construction of jet fluid circulation can be achieved. Therefore, the problems of interferences between coal breaking and coal extraction can be solved. The coal mining efficiency can be improved. At the same time, by recycling the jet fluid through the ground facility units, costs of time and resources can be saved significantly.

BRIEF DESCRIPTION OF THE DRAWINGS

In order to describe technical solutions of the present application or related arts more clearly, accompanying drawings required for describing examples or the related art are introduced briefly in the following. Apparently, the accompanying drawings in the following descriptions only illustrate some examples of the present application, and those of ordinary skill in the art may still derive other drawings from these drawings without creative efforts.

DETAILED DESCRIPTION OF THE EMBODIMENTS

Figure 1:
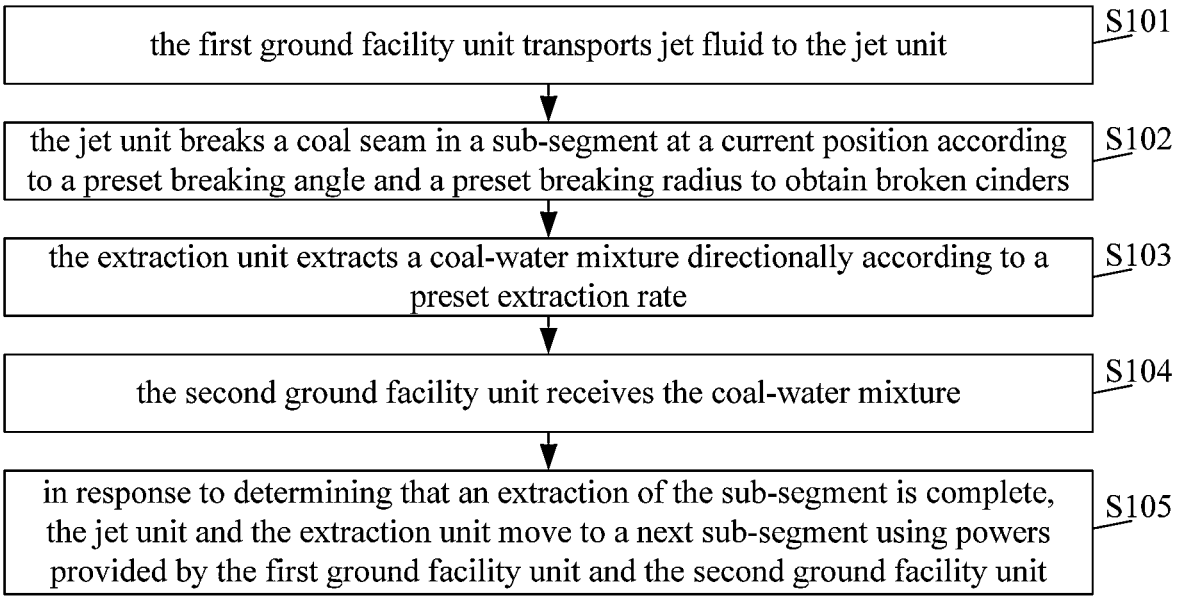
FIG. 1 is a schematic diagram illustrating the integrated mining method of coal breaking, coal extraction and water circulation in a U-well according to examples of the present disclosure.

Hereinafter, in order to make the objective(s), technical solution(s) and advantages of the present application clearer and more understandable, the present application will be further described in detail, in connection with specific embodiments and with reference to the accompanying drawings.

It is necessary to be noted that the technical terms or scientific terms used in the embodiments of the present application should have common meanings as understood by those skilled in the art of the present application, unless otherwise defined. The "first", "second" and similar words used in the embodiments of the present application do not refer to any sequence, number or importance, but are only used to distinguish different component portions. The "comprise", "include" or a similar word means that an element or item before such word covers an element or item or any equivalent thereof as listed after such word, without excluding other elements or items. The "connect" or "interconnect" or a similar word does not mean being limited to a physical or mechanical connection, but may include a direct or indirect electrical connection. The "upper", "lower", "left" and "right" are used only to indicate a relative position relation, and after the absolute position of the described object is changed, the relative position relation may be changed accordingly.

As described above, coal mining and coal transportation are often performed as two dependent processes in conventional methods. However, problems will exist between these two processes. On one hand, there is no integration scheme of coal mining and coal transportation. In conventional methods, the coal-water mixture would accumulate in coal transportation lanes by gravity. In this way, the coal transportation lane would be blocked easily, which would affect the transportation efficiency of the coal. On the other hand, wastes of resources exist and the costs of time and manpower are high. In conventional methods, the coal mining process is carried out first, and the transportation process is carried out later. In these two processes, a plurality of downhole and recovery operations should be carried out. In this way, costs of time and manpower would be quite high. In the same time, the jet fluid used in the coal mining process is difficult to be recycled, therefore, a waste of resources exists.

In view of this, an integrated mining method of coal breaking, coal extraction and water circulation in a U-well is proposed in examples of the present disclosure. In this integrated mining method, coal transportations can be carried out at the same time as the coal mining process. Therefore, the costs of time and manpower would be greatly reduced. Meantime, in the method proposed by the present disclosure, through the first ground facility unit and the second ground facility unit, recycling of the jet fluid can be realized. Therefore, wastes of resources can be avoid.

In the following, the integrated mining method and related device will be further explained in detail with reference to specific examples.

Figure 2:
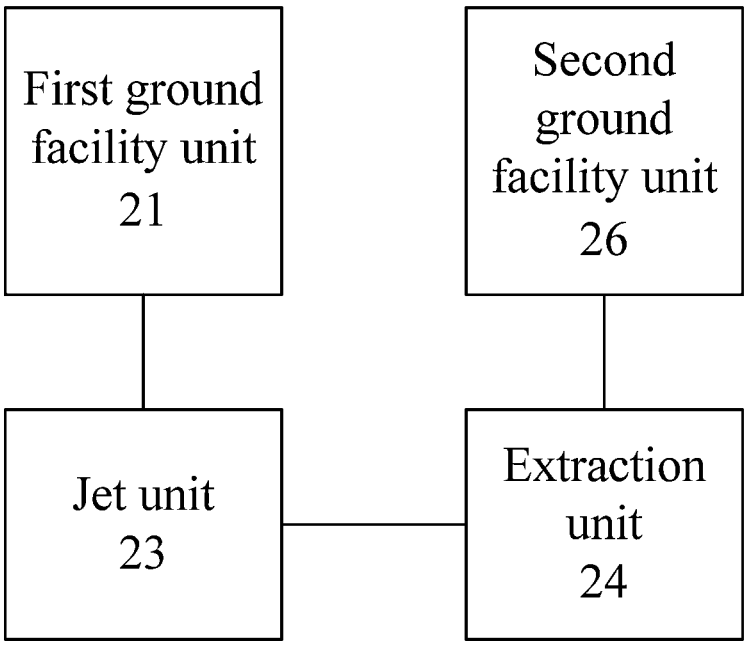
FIG. 2 is a block diagram of the integrated mining system of coal breaking, coal extraction and water circulation in a U-well according to examples of the present disclosure.

As shown in FIG. 2, the integrated mining method provided by example of the present disclosure is applied in an integrated mining system of coal breaking, coal extraction and water circulation in a U-well. The integrated mining system may include: a first ground facility unit 21, a second ground facility unit 26, a jet unit 23 and an extraction unit 24. The coal mining system is disposed in a U-well, which is also called as a U-shape mining passage. The U-well includes a coal breaking section, an extraction hole and a coal breaking hole. The jet unit is disposed on a side of the coal breaking section close to the extraction hole through the coal breaking hole. The extraction unit is disposed on a side of the coal broking section close to the extraction hole through the extraction hole. The first ground facility unit is connected to the jet unit. The second ground facility unit is connected to the extraction unit. The coal breaking section includes a plurality of sub-segments.

In some examples of the present disclosure, the extraction unit may be an air lift reverse circulation extraction unit, for example, an air lift reverse circulation double wall drill.

Figure 4:
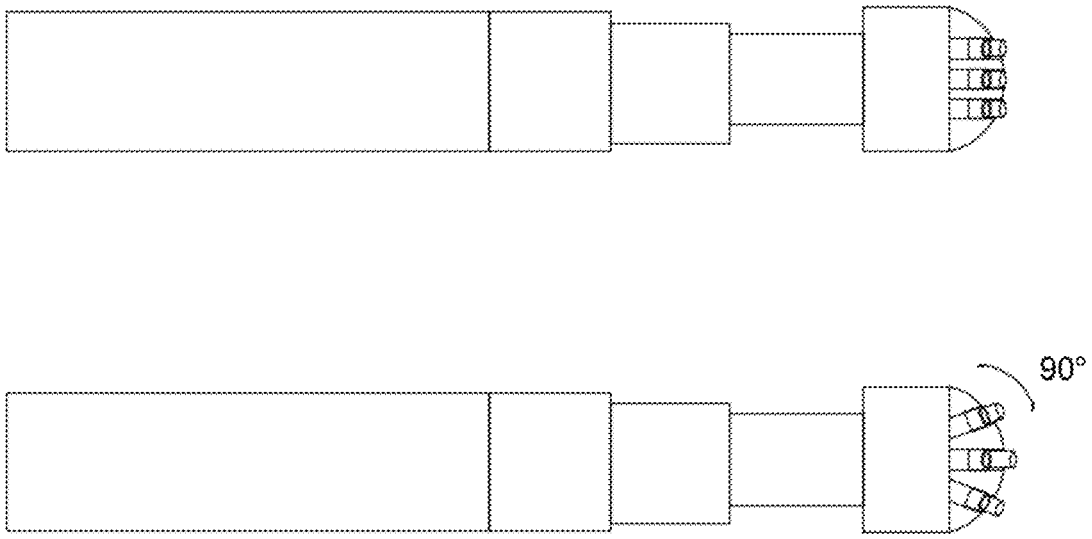
FIG. 4 is a block diagram of a jet lance according to examples of the present disclosure.

As shown in FIG. 4, the U-well may include an extraction hole, a coal breaking hole and a coal breaking section. The coal breaking section may be a horizontal drilling section. The extraction hole, the coal breaking hole and the coal breaking section form a U-shaped mining passage, that is, the U-well. The jet unit and the extraction unit are disposed in the U-shaped mining passage.

In the present application, coal mining and coal transportation are performed at a position in the coal breaking section adjacent to the extraction hole. Initial positions of the jet unit and the extraction unit are on a side of the coal breaking section adjacent to the extraction hole. Moreover, terminal positions of the jet unit and the extraction unit may be on a side of the coal breaking section adjacent to the coal breaking hole.

In some examples of the present disclosure, the integrated mining system may further include a first connecting unit and a second connecting unit. The first connecting unit is connected between the first ground facility unit and the jet unit. The second connecting unit is connected between the second ground facility unit and the extraction unit.

In some examples of the present disclosure, the first ground facility unit is connected to the second ground facility unit.

In a practical application scenario, the U-shape mining passage is determined by the U-well. The jet unit and the extraction unit are disposed in the U-shaped mining passage. The first ground facility unit and the second ground facility unit are disposed on the ground, and connected to the jet unit and the extraction unit.

In some examples of the present disclosure, the integrated mining method may further include a siting method for the U-well, which includes: collecting geological data at a plurality of sites, determining two target sites based on the geological data, and performing a U-well mining based on the two target sites.

Many factors need to be considered when selecting the target sites of the U-well. Moreover, different factors have different importances. There is no clear correspondence between the geological data and a final evaluation.

The fuzzy comprehensive evaluation method is a comprehensive evaluation method based on fuzzy mathematics. The comprehensive evaluation method converts a qualitative evaluation into a quantitative evaluation based on the membership theory of fuzzy mathematics, i.e., using fuzzy mathematics to make an overall evaluation of things or objects subject to a variety of factors. The comprehensive evaluation method has clear results, suitable for solving various non-deterministic problems, and can solve problems which are ambiguous and difficult to quantify.

The siting problem is processed based on a consideration of multiple factors and is a non-deterministic problem. Therefore, in some examples, a fuzzy comprehensive evaluation algorithm may be used to determine the target sites.

A fuzzy evaluation algorithm may include one-stage fuzzy comprehensive evaluation algorithms and multi-stage fuzzy comprehensive evaluation algorithms. In the one-stage fuzzy comprehensive evaluation algorithms, each evaluation factor is of a same level. Therefore, it is possible to build a one-factor evaluation matrix according to a factor set and further calculate a comprehensive evaluation.

Assuming that the target sites are determined using a one-stage fuzzy comprehensive evaluation algorithm, the specific steps of which may include: obtaining geological information of a plurality of sites; constructing a metrics set, a comment set, and a weight set for each site based on the geological information of the plurality of sites; constructing a one-factor evaluation matrix R for each site based on the metrics set and the comment set of the site; where, the one-factor evaluation matrix R indicates a degree of a membership of the metrics set to the comment set; the expression of the one-factor evaluation matrix R is:

$$R = \begin{pmatrix} r_{11} & r_{12} & \dots & r_{1m} \\ r_{21} & r_{2} & \dots & r_{2m} \\ \vdots & \vdots & & \vdots \\ r_{n1} & r_{n2} & \dots & r_{nm} \end{pmatrix}; r_{ij} = \frac{u_{ij}}{\sum_{j=1}^{m} u_{ij}}; \text{where, } r_{ij}$$

denotes a fuzzy variation operator; and $u_{ij}$ denotes an element in the metrics set; obtaining a comprehensive critic for each site according to the one-factor evaluation matrix R through the following formula: B=A×R; where, B represents the comprehensive critic of the site; A represents the weight set of the site; and R represents the one-factor evaluation matrix of the site; and selecting a site with a highest comprehensive critic as a target site.

The multi-stage fuzzy evaluation algorithm is based on the one-stage fuzzy evaluation algorithm. In the multi-stage fuzzy evaluation algorithm, a certain factor may further include some sub-factors. That is, the factor is an evaluation factor, which also includes sub-factors. The siting of the U-well according to examples of the present application can also be achieved using a multi-stage fuzzy evaluation algorithm.

Various fuzzy evaluation algorithms or other algorithms that can evaluate sites of the U-well are within the scope of the present application.

In some examples of the present disclosure, the geological information may include at least one of reserves of harvestable coal, a percentage of shale content, a water enrichment of an extraction layer, etc. The reserves of harvestable coal represent the amount of coal reserves covered by the U-well. The percentage of shale content represents a ratio (%) of unpicked lumps greater than 50 mm in the reserves of harvestable coal. During a coal mining process, roof rocks and floor rocks may be mixed into the coal due to clipping thereby the quality of the coal may be reduced. The percentage of shale content may be used to indicate a degree of reduction in the quality of the coal. The higher the percentage of shale content, the poorer the quality of the coal. The water enrichment of an extraction layer represents the water richness of the extraction layer in the reserves of harvestable coal. In general, the more the water enrichment, the more the water contained in produced fluids.

In some examples of the present disclosure, the geological information may also include configuration factors of an extraction area, ground conditions of a wellhead, and the like.

An actual digging process of a U-well may be divided into three stages: digging two vertical drilling sections, digging two whipstock sections and digging a horizontal drilling section.

Once selecting the target sites of the U-well, the U-well can be exploited on the target sites. In some examples of the present disclosure, the target sites may include a first target site and a second target site. The integrated mining method may include: drilling with a first drill bit in a vertical direction of the first target site until a preset first target point is reached to obtain a first vertical drilling section; drilling with the first drill bit in a vertical direction of the second target site until a preset second target point is reached to obtain a second vertical drilling section; drilling with a second drill bit in a first preset direction from a terminal point of the first vertical drilling section to a ceiling of the coal seam to obtain a first whipstock section; drilling with the second drill bit in a second preset direction from a terminal point of the second vertical drilling section to the ceiling of the coal seam to obtain a second whipstock section; where, the first whipstock section is on a same plane as the second whipstock section; and the first preset direction is opposite to the second preset direction; and drilling with a third drill bit from a terminal point of the first whipstock section to a terminal point of the second whipstock section and from the terminal point of the second whipstock section to the terminal point of the first whipstock section to obtain a horizontal drilling section.

In some examples of the present disclosure, the drilling process of the vertical drilling sections described above can be referred to as a first opening. During this drilling process, a Φ311 mm drill bit can be used to drill to the preset first target point and the preset second target point. Then, a Φ244.5 mm steel pipe would be run in. Moreover, cementing with ordinary 425 Portland cement would be performed. In some examples of the present disclosure, the drilling process of the whipstock sections described above can be referred to as a second opening. During this drilling process, a Φ215.9 mm drill bit may be used to drill into the ceiling of the coal seam (it needs to ensure that the drilling trajectories of the two wells are in a same plane and in opposite directions). Then, a Φ177.8 mm steel pipe would be run in. Moreover, cementing with ordinary 425 Portland cement would be performed. After the second opening, a jet well and an extraction well may be formed. In some examples of the present disclosure, besides the jet well and the extraction well, the U-well may further include a horizontal drilling section. The drilling process of the horizontal drilling section can be referred to as a third opening. During this drilling process, a Φ152 mm drill bit can be used. A horizontal section would be dilled from the jet well to the extraction well or from the extraction well to the jet well until the two wells are connected, and a Φ89 mm glass steel casing would be run in.

In some examples of the present disclosure, the preset first target point and the present second target point may be in a range of 3 meters (m) below a bedrock interface. Adjustment would be made on the positions of the preset first target point and the present second target point depending on field conditions such as weathering bedrock thickness.

To be noted, different drilling methods are all within the scope of the present application as long as they can be used in the exploitation of the U-well.

In practical applications, coal breaking and coal extraction of the coal breaking section is an arduous engineering. The present application thus divides the coal breaking section into a plurality of sub-segments. The plurality of sub-segments may be connected end-to-end in serial. A coal breaking in each of the sub-segments is performed in turn. In some examples of the present disclosure, the length of a sub-segment may be set to 5 m.

In particular, when a first 5 m sub-segment of the coal seam is broken by the jet unit, a drilling machine may move the jet unit back to a second 5 m sub-segment to perform another coal breaking operation. In the other drilling well, the extraction unit, i.e. the air lift reverse circulation double wall drill, may be pushed into the first 5 m sub-segment of the coal seam that has already been broken to complete the coal extraction operation of the first 5 m sub-segment. Note that an advance speed of the exaction unit would be less than that of the jet unit. The above steps would be repeated until an entire face-cutting operation is completed. That is, when a third 5 m sub-segment of the coal seam is broken by the jet unit, the extraction unit may be pushed into the second 5 m sub-segment to complete the coal extraction operation of the second 5 m sub-segment. When a fourth 5 m sub-segment of the coal seam is broken by the jet unit, the extraction unit may be pushed into the third 5 m sub-segment to complete the coal extraction operation of the third 5 m sub-segment, etc. In this procedure, the coal breaking process and the extraction process are alternatively performed.

With reference to FIG. 1, the integrated mining method of coal breaking, coal extraction and water circulation in a U-well according to an example of the present disclosure may include the following operations which are iteratively performed until the above-described extraction of the coal breaking section is complete.

In step S101, the first ground facility unit transports jet fluid to the jet unit.

In examples of the present disclosure, the jet fluid may be pressurized jet fluid.

In some examples of the present disclosure, the coal mining system of the U-well may further include a jet subsystem and an extraction subsystem. Where, the jet subsystem may include the jet unit and the first ground facility unit. The jet subsystem is configured to break the coal breaking section using a jet breaking technique to obtain the broken cinders.

In some examples of the present disclosure, the jet subsystem may further include a first connecting unit.

In particular, the jet unit is disposed on one side of the extraction hole in the coal breaking section and is connected to the first ground facility unit through the first connecting unit. The first ground facility unit is configured to pressurize the jet fluid, transport the jet fluid to the jet unit, provide rotational, forward, and reverse powers to the jet unit, provide the jet fluid to break the coal, and provide the pressure at which the jet fluid may break the coal mass. The first connecting unit is configured to transmit the jet fluid. The jet unit is configured to perform a jet breaking with the jet fluid.

In Step S102: the jet unit breaks a coal seam in a sub-segment at a current position according to a preset breaking angle and a preset breaking radius to obtain broken cinders.

In examples of the present disclosure, the jet unit may include: a jet lance; where, the jet lance is provided with a spray nozzle; a spray direction of the spray nozzle is at an acute angle to a directional drill pipe of the extraction unit.

As described above, the jet unit is used for jet breaking with the jet fluid.

In some examples of the present disclosure, the coal breaking operation is a retrograde coal breaking operation using a jet unit. The coal breaking process may include: after the third opening is complete, the percussive pressure of the drill bit may cause initial cracks in the borehole surrounding the coal breaking section. At the same time, stress of the surrounding rock of the borehole may be redistributed. The initial cracks would be further developed under a combined effect of tensile stress and shear stress. Afterwards, a cooperative action of the water jets may cause the cracks to penetrate. Thus, the surrounding rocks may crush. In turn, the propagation of the stress wave may further increase a damage range of the coal rock. Finally, a macroscopic slit may be formed by the jets and the coal mass around the borehole may break down. To be noted, various jet breaking methods are all within the scope of the present application as long as they can achieve an objective of coal mining.

In particular, when the displacement of the jet fluid reaches a certain level, a sufficient jet pressure differential may be generated inside and outside the spray nozzle of the jet unit to accelerate abrasive slurry through the outer section of the spray nozzle, and to generate a huge impact force after acting on the ground of the drilling tool. If abrasive materials are added into the jet fluid, a stream flowing through the outer section of the spray nozzle may have a greater erosion effect, thereby a passage for subsequent cement extrusion may be formed.

FIG. 4 shows a jet lance according to some examples of the present disclosure. In order to extract remaining coal sufficiently, the jet lance may be provided with a 6*6 mm spray nozzle. The spray nozzle may be in an acute angle (0-90°, which is adjustable) with respect to a direction pointing towards the extraction unit. The acute angle may ensure on one hand the jet depth of the jet fluid and on the other hand the extraction kinetic energy of the extraction unit. Therefore, a coal extraction effect of the extraction unit may be ensured.

It should be appreciated that the smaller the breaking angle, the greater the kinetic energy available for the coal extraction operation. Accordingly, the jet unit may require a greater water pressure to complete the coal breaking operation while keeping the breaking unchanged.

The applicant found that difficulties in performing a coal breaking operation and a coal extraction operation at the same time is how to make the jet unit works in conjunction with the extraction unit. The jet unit utilizes high-pressure jet fluid to break the coal seam. However, a U-well is permeable due to fractures in the wall of the well. If the jet fluid will not be recycled in time, a loss of the jet fluid may occur. Therefore, a mixture of the jet fluid and the broken cinders may be accumulated in the channel or a waste of power of the extraction subsystem may occur if the amount of the jet fluid is not set properly.

In some examples of the present disclosure, the step of the jet unit breaking a coal seam in a sub-segment at a current position according to a preset breaking angle and a preset breaking radius to obtain broken cinders may include: determining an extraction rate of the extraction unit; calculating an injection rate of the jet fluid according to the extraction rate of the extraction unit; injecting, by the jet unit, a stream of the jet fluid into the sub-segment according to the injection rate of the jet fluid to break the coal into the broken cinders.

In some examples of the present disclosure, the injection rate of the jet fluid may be calculated according to the following formulas:

$$Q1 = Q2 + Q3$$

$$Q2 = 4\pi r \frac{1}{k^{1/m}} \left(\frac{m}{2m+1}\right) \left(\frac{\omega}{2}\right)^{\frac{2m+1}{m}} \left(\left(-\frac{dp}{dr}\right)\left(1 - \frac{\tau_y}{-\frac{\omega}{2}\frac{dp}{dr}}\right)\right)^{1/m} \times \left(1 - \frac{1}{m+1}\left(\frac{\tau_y}{-\frac{\omega}{2}\frac{dp}{dr}}\right) - \frac{m}{m+1}\left(\frac{\tau_y}{-\frac{\omega}{2}\frac{dp}{dr}}\right)^2\right)$$

where, Q1 represents the injection rate of the jet fluid; Q2 represents a loss rate of the jet fluid; Q3 represents the extraction rate of the extraction unit; r represents a radial loss distance; m represents a flow pattern index; ω represents a fracture opening; p represents a pressure of the jet fluid; k represents a consistency coefficient; and $\tau_y$ represents a shear stress.

In some examples of the present disclosure, the injection rate of the jet fluid can also be set to be greater than a sum of the extraction rate of the extraction unit and a loss rate of the jet fluid. To be noted, different setting methods thereof are all within the protection scope of the present application.

The use of the jet unit and the extraction unit in examples of the present disclosure enables simultaneous coal breaking and coal extraction. Synchronization of coal breaking and coal extraction not only reduces a waste of time and labor costs, but also reduces a waste of resources such as jet fluid.

In Step S103, the extraction unit extracts a coal-water mixture directionally according to a preset extraction rate; where, the coal-water mixture includes: the broken cinders and the jet fluid.

As noted above, the coal mining system of the U-well according to examples of the present disclosure may include an extraction subsystem.

According to some examples of the present disclosure, the extraction subsystem may include an extraction unit and a second ground facility unit. In some examples, the extraction subsystem may further include a second connecting unit.

The extraction unit is configured to extract a coal-water mixture. The second connecting unit is configured to connect the extraction unit and the second ground facility unit to transport the coal-water mixture. The second ground facility unit is configured to provide the extraction unit with a power to rotate, advance and retreat, a power to lift the coal-water mixture, and to receive and separate the coal-water mixture to obtain the broken cinders.

Specifically, in some examples, the portion of the second connecting unit connected to the second ground utility unit is an air lift reverse circulation double walled drill pipe. The portion of the second connecting unit connected to the extraction unit is a directional drill pipe. The second ground facility unit includes a hollow compressor for providing compressed air. The second ground facility unit further comprises an air water tap or an air box.

The extraction subsystem may inject compressed air from a mixer to an inner pipe to form a myriad of small bubbles. The compressed air may be injected to the inner pipe through the air water tap or the air box, the double walled drill pipe, an annular gap between the inner pipe and an outer pipe of the double walled drill pipe to generate many small bubbles. The small bubbles may rise rapidly along the inner pipe and expand simultaneously. As the compressed air enters the coal-water mixture, a coal-water-air mixture is formed. And as the compressed air continues to enter the coal-water-air mixture, the density of the coal-water-air mixture may be reduced continuously. As a result, the coal-water-air mixture at the bottom of the well may be carried out to the ground.

Specifically, assuming a height difference of the air water tap or the air box to a top surface of the coal-water mixture inside the well is $h_1$, a height difference from the top surface to a bottom surface of the coal-water mixture inside the well is $h_2$, the density of the coal-water mixture is $\rho_1$, the coal-water-air mixture mixed with air injected by the soda faucet has a density of $\rho_2$, the pressure of the jet water is P, and the jet direction is at an angle θ to the direction of the reverse-cycle dedicated roller cone bit. The pressure acting on the coal-water mixture around the reverse-cycle dedicated roller cone bit is: $\Delta P = \rho_1 \times h_1 + P \cos\theta - \rho_1 \times (h_1 + h_2)$. It is this pressure that acts to continuously raise the coal-water mixture up to the ground.

In Step S104, the second ground facility unit receives the coal-water mixture.

In this step, the coal-water mixture may include broken cinders and the jet fluid. The jet fluid described above are the jet fluid remained after the coal breaking operation.

In examples of the present disclosure, the second ground facility unit may further include a coal-water-air separation device. The coal, the air, and the water may be extracted from the coal-water-air mixture by the coal-water-air separation device. In this process, the jet fluid and the broken cinders.

In Step S105, in response to determining that an extraction of the sub-segment is complete, the jet unit and the extraction unit move to a next sub-segment using powers provided by the first ground facility unit and the second ground facility unit.

The applicant also found that the jet fluid used for the coal breaking can be recycled. That is, by connecting units of the jet subsystem and the extraction subsystem on the ground or under the ground, the jet fluid may be recycled, and wastes of resources may be avoided.

In some examples of the present disclosure, the first ground facility unit is connected to the second ground facility unit. After the second ground facility unit receives the coal-water mixture, the method may further include: separating, by the second ground facility unit, the coal-water mixture to obtain the jet fluid and the broken cinders; and transporting, by the second ground facility unit, the jet fluid to the first ground facility unit.

In some examples of the present disclosure, the first ground facility unit and the second ground facility unit may be connected by a hose.

In some examples of the present disclosure, the coal breaking operation may be performed by the jet unit. The extraction operation may be performed after the coal breaking of the sub-segment is complete. Moreover, the jet unit may pause its operation during the extraction operation.

In some examples of the present disclosure, the coal breaking operation may be performed by the jet unit while the extraction operation is performed by the extraction unit. That is, the jet unit and the extraction unit may work or pause at the same time.

In some examples of the present disclosure, the extraction unit may work continuously, and the jet unit may work or pause according to actual situations.

It is within the scope of the present application that the jet unit and the extraction unit can be operated in a different manner so long as the same object can be achieved.

It is noted that some examples of the present disclosure have been described above. Other examples are within the scope of the present disclosure. In some examples, the actions or steps recited in the claims can be performed in an order different from that described above and still achieve desirable results. In addition, the processes depicted in the accompanying figures do not necessarily require the particular order shown, or sequential order, to achieve desirable results. In certain implementations, multitasking and parallel processing may also be or may be advantageous.

Based on a same inventive concept, corresponding to any method described above, the present disclosure also provides an integrated mining system of coal breaking, coal extraction and water circulation in a U-well.

As shown in FIG. 2, the integrated mining system may include: a first ground facility unit 21, a second ground facility unit 26, a jet unit 23 and an extraction unit 24. The coal mining system may be disposed in a U-well, which is also called a U-shape mining passage. The U-well or the U-shape mining passage may include a coal breaking section, an extraction hole and a coal breaking hole. The jet unit 23 may be disposed on a side of the coal breaking section close to the extraction hole through the coal breaking hole. The extraction unit 24 may be disposed on a side of the coal broking section close to the extraction hole through the extraction hole. The first ground facility unit 21 may connect to the jet unit 23. The second ground facility unit 26 may connect to the extraction unit 24. The coal breaking section may include a plurality of sub-segments.

The first ground facility unit 21, the jet unit 23, the extraction unit 24 and the second ground facility unit 26 are configured to perform the following operations iteratively until the extraction of the coal breaking section is complete.

The first ground facility unit 21 is configured to transport jet fluid to the jet unit 23.

The jet unit 23 is configured to break a coal seam in a sub-segment at a current position according to a preset breaking angle and a preset breaking radius to obtain broken cinders; where, the jet unit 23 includes: a jet lance; where, the jet lance is provided with a spray nozzle; a spray direction of the spray nozzle is at an acute angle to a directional drill pipe of the extraction unit.

The extraction unit 24 is configured to extract a coal-water mixture directionally according to a preset extraction rate; where, the coal-water mixture includes: the broken cinders and the jet fluid.

The second ground facility unit 26 is configured to receive the coal-water mixture.

In response to determining that an extraction of the sub-segment is complete, the jet unit 23 and the extraction unit 24 is configured to move to a next sub-segment using powers provided by the first ground facility unit 21 and the second ground facility unit 26.

In some examples of the present disclosure, the first ground facility unit 21 is connected to the second ground facility unit 26.

In some examples of the present disclosure, the second ground facility unit 26 is configured to perform a separation on the coal-water mixture to obtain the jet fluid and the broken cinders; and transmit the jet fluid to the first ground facility unit 21.

In some examples of the present disclosure, the coal mining system of the U-well may further includes a first connecting unit 22 and a second connecting unit 24; where, the first connecting unit 22 is connected between the first ground facility unit 21 and the jet unit 23; the second connecting unit 25 is connected between the second ground facility unit 26 and the extraction unit 24.

In some examples of the present disclosure, the first connecting unit 22 is configured to receive the jet fluid and deliver the jet fluid to the jet unit 23.

In some examples of the present disclosure, the second connecting unit 25 is configured to receive the coal-water mixture and deliver the coal-water mixture to the second ground facility unit 26.

Figure 3:
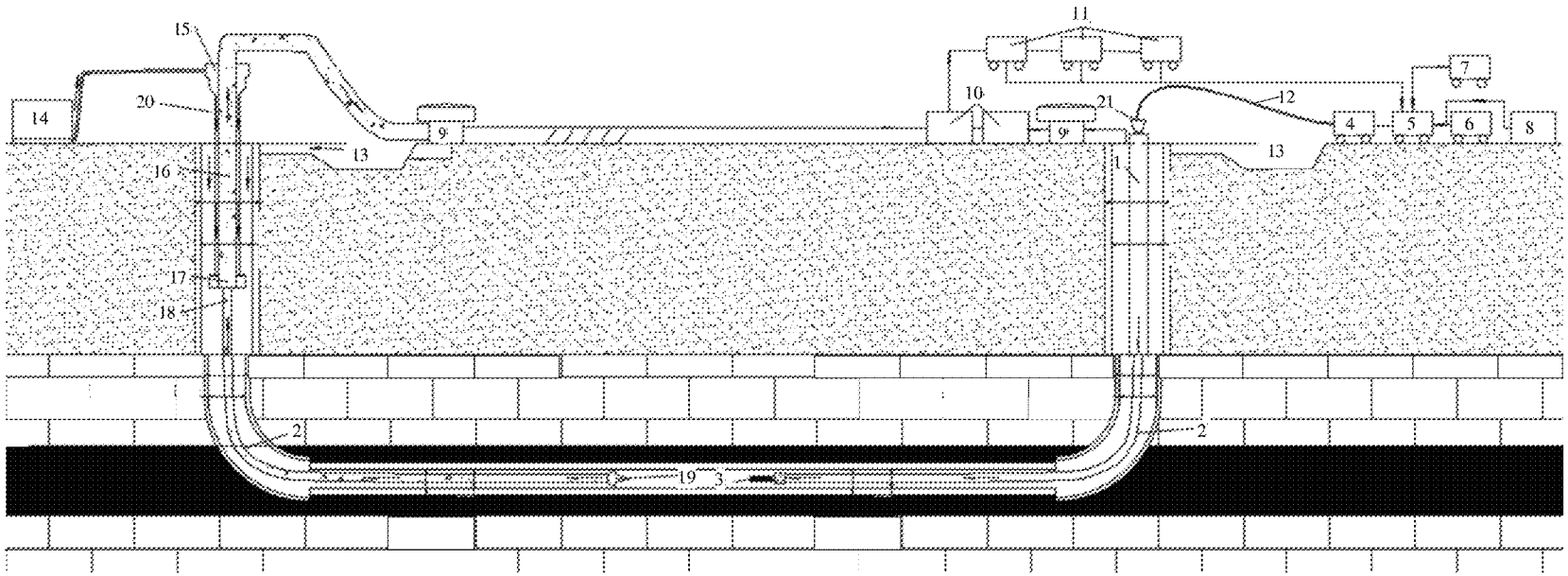
FIG. 3 is a block diagram of the integrated mining system of coal breaking, coal extraction and water circulation in a U-well according to another example of the present disclosure.

Referring to FIG. 3, the integrated mining system according to one or more examples of the present disclosure may include a jet tool set 3, an air lift reverse circulation double wall drill, a coal-water-air separator 9, and a high-pressure hose 12.

In some examples of the present disclosure, the air lift reverse circulation double wall drill may include: a double wall drill pipe 16, an air liquid mixer 17, a single wall drill pipe 18, a directional sub 2 and a reverse circulation dedicated roller cone drill bit.

In some examples of the present disclosure, the jet tool set 3 may be connected to a drill pipe 1 and the directional sub 2. Moreover, the jet tool set 3 may be disposed in the well.

In some examples of the present disclosure, the drill pipe 1 may also be connected to at least one of a frac truck 4, a sand blending truck 5, a sand tank truck 6, an instrumentation truck 7, a clean water tank 8, a coal-water-air separator 9, a jet fluid tank 10, a frac tank truck 11, and a settling pond 13 to perform the coal breaking operation. In some examples of the present disclosure, the sand blending truck 5, the sand tank truck 6, the instrumentation truck 7, and the clean water tank 8 may be used to mix the jet fluid. Then, the jet fluid may be transported to the jet tool set 3 through the frac truck 4, the drill pipe 1, and the directional sub 2. Moreover, a receding coal breaking may be achieved by the jet tool set 3. In some examples of the present disclosure, the jet fluid spilled from the wellhead can be recycled through the coal-water-air separator 9 and the settling pond 13 after a solid-liquid separation. Then, the jet fluid recycled may be injected in to the sand blending truck 5 through the jet fluid tank 10 and the frac tank truck 11.

The working principle of the air lift reverse circulation double wall drill is similar to the working principle of an air lift pumping. In some examples of the present disclosure, the compressed air may be injected by an air compressor 14 to the inner pipe through the air water tap or the air box 15, the double walled drill pipe 16, an annular gap between the inner pipe and an outer pipe of the double walled drill pipe 16 to generate many small bubbles. The small bubbles may rise rapidly along the inner pipe and expand simultaneously. As the compressed air enters the coal-water mixture, a coal-water-air mixture is formed. And as the compressed air continues to enter the coal-water-air mixture, the density of the coal-water-air mixture may be reduced continuously. That is, an air-water mixture with a low specific gravity may be formed at the top of the air liquid mixer 17. However, the liquid in the well is with a high specific gravity. As a result, the coal-water-air mixture at the bottom of the well may be carried out to the ground continuously through the single wall drill pipe 18, the directional sub 2 and a reverse-circulation dedicated roller cone bit 19 due to a difference in pressure according to the principle of a communicator.

In particular, when in one drilling well, a first sub-segment of the coal seam is broken by the jet unit, a drilling machine may move the directional sub 2 and the jet tool set 3 back to a second sub-segment to perform a second coal breaking operation. In the other drilling well, the reverse-circulation dedicated roller cone bit 19 may be pushed into the first sub-segment of the coal seam to complete the coal extraction operation of the first sub-segment. The above steps would be repeated until an entire face-cutting operation is completed. That is, when a third sub-segment of the coal seam is broken, the coal extraction operation of the second sub-segment may be performed simultaneously. When a fourth sub-segment of the coal seam is broken, the coal extraction operation of the third sub-segment may be performed simultaneously. In this procedure, the coal breaking process and the extraction process are alternatively performed. Moreover, after extracted from the extraction well 20, the coal-water-air mixture is processed through the coal-water-air separator 9. The separated jet fluid may be re-injected into the jet unit 21 for reuse. Therefore, wastes of resources may be avoided.

It is noted that some examples of the present disclosure have been described above. Other examples are within the scope of the following claims. In some cases, the acts or steps recited in the claims may be performed in a different order than in the examples described above and can still achieve desirable results. Additionally, the processes depicted in the accompanying drawings do not necessarily require the particular order shown, or sequential order, to achieve desirable results. In some examples, multi-tasking and parallel processing are also possible or may be advantageous.

The examples of the disclosure are intended to embrace all such alternatives, modifications, and variations as to fall within the broad scope of the appended claims. Therefore, any omission, modification, equivalent replacement and improvement made within the spirits and principles of the examples of the present disclosure shall fall within the protection scope of the present disclosure.

What is claimed is:

1. A coal mining method in a U-well, applied in a coal mining system in the U-well, wherein, the coal mining system in the U-well comprises: a first ground facility unit, a second ground facility unit, a jet unit and an extraction unit; the coal mining system is disposed in the U-well; the U-well comprises: a coal breaking section, an extraction hole and a coal breaking hole; the coal breaking section is a horizontal drilling section; wherein, the jet unit is disposed on a side of the coal breaking section close to the extraction hole through the coal breaking hole; the extraction unit is disposed on a side of the coal breaking section close to the extraction hole through the extraction hole; the first ground facility unit connects to the jet unit; the second ground facility unit connects to the extraction unit; the coal breaking section comprises a plurality of sub-segments; initial positions of the jet unit and the extraction unit are on a side of the coal breaking section adjacent to the extraction hole; terminal positions of the jet unit and the extraction unit are on a side of the coal breaking section adjacent to the coal breaking hole;

the method comprises following steps which are performed iteratively until the extraction of the coal breaking section is complete:

transporting, by the first ground facility unit, jet fluid pressurized to the jet unit;

breaking, by the jet unit, a coal seam in one sub-segment of the plurality of sub-segments at a current position according to a preset breaking angle and a preset breaking radius to obtain broken cinders; wherein, the jet unit comprises: a jet lance; wherein, the jet lance is provided with a spray nozzle; a spray direction of the spray nozzle is at an acute angle to a directional drill pipe of the extraction unit;

extracting, by the extraction unit, a coal-water mixture directionally according to a preset extraction rate; wherein, the coal-water mixture comprises: the broken cinders and the jet fluid;

receiving, by the second ground facility unit, the coal-water mixture; and in response to determining that an extraction of the sub-segment is complete, moving, by the jet unit and the extraction unit, to a next sub-segment using powers provided by the first ground facility unit and the second ground facility unit; wherein, the breaking, by the jet unit, a coal seam in one sub-segment of the plurality of sub-segments at a current position according to a preset breaking angle and a preset breaking radius to obtain broken cinders comprises:

determining the preset extraction rate of the extraction unit;

calculating an injection rate of the jet fluid according to the preset extraction rate of the extraction unit; and injecting, by the jet unit, a stream of the jet fluid into the sub-segment according to the injection rate of the jet fluid, the preset breaking angle and the preset breaking radius to break the coal into the broken cinders; wherein, the injection rate of the jet fluid is calculated according to following formulas:

$$Q1 = Q2 + Q3$$

$$Q2 = 4\pi r \frac{1}{k^{1/m}} \left(\frac{m}{2m+1}\right) \left(\frac{\omega}{2}\right)^{\frac{2m+1}{m}} \left(\left(-\frac{dp}{dr}\right)\left(1 - \frac{\tau_y}{-\frac{\omega}{2}\frac{dp}{dr}}\right)\right)^{1/m} \times \left(1 - \frac{1}{m+1}\left(\frac{\tau_y}{-\frac{\omega}{2}\frac{dp}{dr}}\right) - \frac{m}{m+1}\left(\frac{\tau_y}{-\frac{\omega}{2}\frac{dp}{dr}}\right)^2\right)$$

wherein, k represents a consistency coefficient; Q1 represents the injection rate of the jet fluid; Q2 represents a loss rate of the jet fluid; Q3 represents the preset extraction rate of the extraction unit; r represents a radial loss distance; m represents a flow pattern index; ω represents a fracture opening; p represents a pressure of the jet fluid; and $\tau_y$ represents a shear stress.

2. The method according to claim 1, wherein, the first ground facility unit is connected to the second ground facility unit;

after receiving, by the second ground facility unit, the coal-water mixture, the method further comprises:

performing, by the second ground facility unit, a separation on the coal-water mixture to obtain the jet fluid and the broken cinders; and transmitting, by the second ground facility unit, the jet fluid to the first ground facility unit.

3. The method according to claim 1, wherein, the coal mining system in the U-well further comprises: a first connecting unit and a second connecting unit; wherein, the first connecting unit is connected to the first ground facility unit and the jet unit; and the second connecting unit is connected to the second ground facility unit and the extraction unit;

the method further comprises:

receiving, by the first connecting unit, the jet fluid and delivering the jet fluid to the jet unit;

receiving, by the second connecting unit, the coal-water mixture and delivering the coal-water mixture to the second ground facility unit.

4. A coal mining system in a U-well, comprising: a first ground facility unit, a second ground facility unit, a jet unit and an extraction unit; wherein, the coal mining system is disposed in the U-well; the U-well comprises: a coal breaking section, an extraction hole and a coal breaking hole; the coal breaking section is a horizontal drilling section; wherein, the jet unit is disposed on a side of the coal breaking section close to the extraction hole through the coal breaking hole; the extraction unit is disposed on a side of the coal breaking section close to the extraction hole through the extraction hole; the first ground facility unit connects to the jet unit; the second ground facility unit connects to the extraction unit; the coal breaking section comprises a plurality of sub-segments; initial positions of the jet unit and the extraction unit are on a side of the coal breaking section adjacent to the extraction hole; terminal positions of the jet unit and the extraction unit are on a side of the coal breaking section adjacent to the coal breaking hole;

the first ground facility unit, the jet unit, the extraction unit, and the second ground facility unit are configured to perform following operations iteratively until the extraction of the coal breaking section is complete:

the first ground facility unit is configured to transport jet fluid pressurized to the jet unit;

the jet unit is configured to break a coal seam in one sub-segment of the plurality of sub-segments at a current position according to a preset breaking angle and a preset breaking radius to obtain broken cinders; wherein, the jet unit comprises: a jet lance; wherein, the jet lance is provided with a spray nozzle; a spray direction of the spray nozzle is at an acute angle to a directional drill pipe of the extraction unit;

the extraction unit is configured to extract a coal-water mixture directionally according to a preset extraction rate; wherein, the coal-water mixture comprises: the broken cinders and the jet fluid;

the second ground facility unit is configured to receive the coal-water mixture; and in response to determining that an extraction of the sub-segment is complete, the jet unit and the extraction unit is configured to move to a next sub-segment using powers provided by the first ground facility unit and the second ground facility unit; wherein, the jet unit is configured to break a coal seam in one sub-segment of the plurality of sub-segments at a current position according to a preset breaking angle and a preset breaking radius to obtain broken cinders by:

determining the preset extraction rate of the extraction unit;

calculating an injection rate of the jet fluid according to the preset extraction rate of the extraction unit; and injecting, by the jet unit, a stream of the jet fluid into the sub-segment according to the injection rate of the jet fluid, the preset breaking angle and the preset breaking radius to break the coal into the broken cinders; wherein, the injection rate of the jet fluid is calculated according to following formulas:

$$Q1 = Q2 + Q3$$

$$Q2 = 4\pi r \frac{1}{k^{1/m}}\left(\frac{m}{2m+1}\right)\left(\frac{\omega}{2}\right)^{\frac{2m+1}{m}} \left(\left(-\frac{dp}{dr}\right)\left(1-\frac{\tau_y}{-\frac{\omega}{2}\frac{dp}{dr}}\right)\right)^{1/m} \times \left(1-\frac{1}{m+1}\left(\frac{\tau_y}{-\frac{\omega}{2}\frac{dp}{dr}}\right)-\frac{m}{m+1}\left(\frac{\tau_y}{-\frac{\omega}{2}\frac{dp}{dr}}\right)^2\right)$$

wherein, k represents a consistency coefficient; Q1 represents the injection rate of the jet fluid; Q2 represents a loss rate of the jet fluid; Q3 represents the preset extraction rate of the extraction unit; r represents a radial loss distance; m represents a flow pattern index; ω represents a fracture opening; p represents a pressure of the jet fluid; and $\tau_y$ represents a shear stress.

5. The integrated mining system according to claim 4, wherein, the first ground facility unit is connected to the second ground facility unit;

the second ground facility unit is configured to perform a separation on the coal-water mixture to obtain the jet fluid and the broken cinders; and transmit the jet fluid to the first ground facility unit.

6. The integrated mining system according to claim 4, further comprising: a first connecting unit and a second connecting unit; wherein, the first connecting unit is connected to the first ground facility unit and the jet unit; the second connecting unit is connected to the second ground facility unit and the extraction unit;

the first connecting unit is configured to receive the jet fluid and deliver the jet fluid to the jet unit; and the second connecting unit is configured to receive the coal-water mixture and deliver the coal-water mixture to the second ground facility unit.

* * * * *